US009994934B2

(12) United States Patent
Smarsly et al.

(10) Patent No.: US 9,994,934 B2
(45) Date of Patent: Jun. 12, 2018

(54) CREEP-RESISTANT TIA1 ALLOY

(71) Applicant: MTU Aero Engines AG, Munich (DE)

(72) Inventors: Wilfried Smarsly, Munich (DE); Helmut Clemens, Leoben (AT); Emanuel Schwaighofer, Leoben (AT)

(73) Assignee: MTU Aero Engines AG, Munich (DE)

( * ) Notice: Subject to any disclaimer, the term of this patent is extended or adjusted under 35 U.S.C. 154(b) by 810 days.

(21) Appl. No.: 14/481,295

(22) Filed: Sep. 9, 2014

(65) Prior Publication Data

US 2015/0086414 A1 Mar. 26, 2015

(30) Foreign Application Priority Data

Sep. 20, 2013 (EP) ..... 13185280

(51) Int. Cl.

| | |
|---|---|
| ***C22C 14/00*** | (2006.01) |
| ***C22C 1/02*** | (2006.01) |
| ***C22F 1/18*** | (2006.01) |
| ***C22F 1/00*** | (2006.01) |

(52) U.S. Cl.

CPC ..... *C22C 14/00* (2013.01); *C22C 1/02* (2013.01); *C22F 1/002* (2013.01); *C22F 1/183* (2013.01); *F05D 2300/133* (2013.01)

(58) Field of Classification Search

CPC ... C22C 14/00; C22C 1/00; C22C 1/02; C22F 1/00; C22F 1/002; C22F 1/183; F05D 2300/133

See application file for complete search history.

(56) References Cited

U.S. PATENT DOCUMENTS

| | | | | |
|---|---|---|---|---|
| 5,350,466 | A * | 9/1994 | Larsen, Jr. | C22C 14/00 148/421 |
| 8,876,992 | B2 | 11/2014 | Das | |
| 2011/0189026 | A1 | 8/2011 | Smarsly et al. | |
| 2011/0219912 | A1 | 9/2011 | Achtermann et al. | |
| 2011/0277891 | A1 | 11/2011 | Clemens et al. | |

(Continued)

FOREIGN PATENT DOCUMENTS

| | | | |
|---|---|---|---|
| EP | 2423340 | A | 2/2012 |
| EP | 2620517 | A1 | 7/2013 |
| WO | 2012041276 | A2 | 4/2012 |

(Continued)

OTHER PUBLICATIONS

Clemens H et al.: "In and ex situ investigations of the beta-phase in a Nb and Mo containing gamma-TiAl based alloy", Intermetallics, Elsevier Science Publishers B.V. GB, vol. 16, No. 6, Jun. 2008, pp. 827-833.

(Continued)

*Primary Examiner* — Jennifer A Smith
*Assistant Examiner* — Alexandra M Moore
(74) *Attorney, Agent, or Firm* — Abel Law Group, LLP

(57) ABSTRACT

Disclosed is a TiAl alloy for high-temperature applications which comprises not more than 43 at. % of Al, from 3 at. % to 8 at. % of Nb, from 0.2 at. % to 3 at. % of Mo and/or Mn, from 0.05 at. % to 0.5 at. % of B, from 0.1 at. % to 0.5 at. % of C, from 0.1 at. % to 0.5 at. % of Si and Ti as balance. Also disclosed is a process for producing a component made of this TiAl alloy and the use of corresponding TiAl alloys in components of flow machines at operating temperatures up to 850° C.

15 Claims, 1 Drawing Sheet

(56) References Cited

U.S. PATENT DOCUMENTS

| | | | | |
|---|---|---|---|---|
| 2012/0048430 | A1* | 3/2012 | Das | B21J 1/00 148/557 |
| 2014/0202601 | A1 | 7/2014 | Helm et al. | |

FOREIGN PATENT DOCUMENTS

| | | | |
|---|---|---|---|
| WO | 2013020548 | A1 | 2/2013 |
| WO | 2013110260 | A1 | 8/2013 |

OTHER PUBLICATIONS

Guether Volker et al."Microstructure and corresponding tensile properties of as-cast,. beta.-solidifying,. gamma.-TiAl based TNM alloys", Gamma, Titatium, Aluminides, Proceedings of a Symposium, XX, XX, Mar. 9, 2008, pp. 249-256.

* cited by examiner

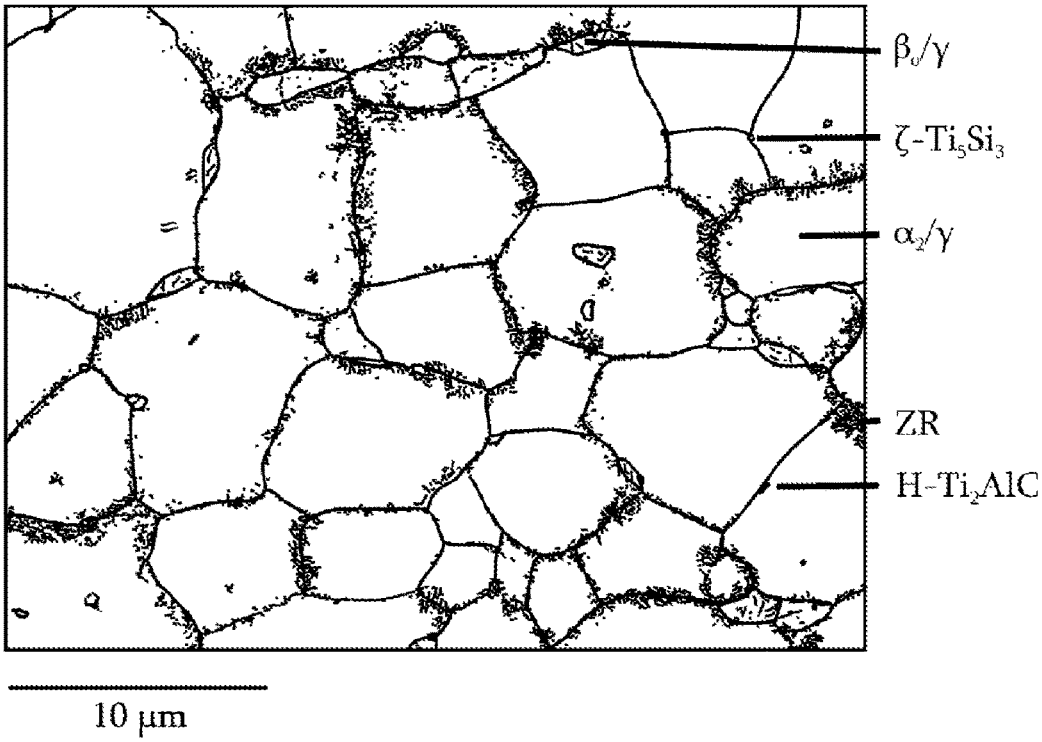
$\beta_0/\gamma$
$\zeta$-$Ti_5Si_3$
$\alpha_2/\gamma$
ZR
H-$Ti_2AlC$
10 μm

CREEP-RESISTANT TIA1 ALLOY

CROSS-REFERENCE TO RELATED APPLICATIONS

The present application claims priority under 35 U.S.C. § 119 of European Patent Application No. 13185280.8, filed Sep. 20, 2013, the entire disclosure of which is expressly incorporated by reference herein.

BACKGROUND OF THE INVENTION

1. Field of the Invention

The present invention relates to a TiAl alloy which comprises titanium and aluminum and also niobium and molybdenum and/or manganese and is referred to in technical circles as TNM alloy.

2. Discussion of Background Information

TiAl alloys based on the intermetallic phase γ-TiAl are predestined for use in flow machines such as stationary gas turbines and aircraft engines because of their low specific weight and the high strength due to the ordered intermetallic phase. Thus, for example, US 2011/0189026 A1, the entire disclosure of which is incorporated by reference herein, describes a TiAl-based alloy for the production of gas turbine components. The alloy described there is a TNM alloy containing from 42 to 45 at. % of aluminum, from 3 to 8 at. % of niobium and from 0.2 to 3 at. % of molybdenum and/or manganese. In addition, from 0.1 to 1 at. % of boron and/or carbon and/or silicon can be present. The balance of the alloy is formed by titanium. Alloys of this type, which comprise, in particular, 43.5 at. % of aluminum, 4 at. % of niobium, 1 at. % of molybdenum and 0.1% of boron with titanium as balance, are suitable for use at operating temperatures of from 750° C. to 780° C.

The microstructure of such TNM alloys is built up in a complex manner of a plurality of phases and comprises γ-TiAl, $\alpha_2$-$Ti_3Al$ and $\beta_o$/B2-titanium.

A further alloy having a microstructure made up of γ-TiAl, $\alpha_2$-$Ti_3Al$ and β-phase is described in US 2011/0277891, the entire disclosure of which is incorporated by reference herein. This alloy comprises from 42 to 44.5 at. % of aluminum, from 3.5 to 4.5 at. % of niobium, from 0.5 to 1.5% of molybdenum, up to 2.2 at. % of manganese, from 0.05 to 0.2 at. % of boron, from 0.001 to 0.01 at. % of silicon, from 0.001 to 1.0 at. % of carbon, from 0.001 to 0.1 at. % of oxygen, from 0.0001 to about 0.002 at. % of nitrogen with titanium and impurities as balance.

However, the usability of the TNM alloys described is restricted to temperatures below 800° C. since an unsatisfactory creep resistance is observed during prolonged use at higher temperatures and this results in an unsatisfactory life for use in flow machines such as stationary gas turbines or aircraft engines.

It would therefore be advantageous to have available a TiAl alloy which has relatively high use temperatures in the range above 800° C. and in particular an improved creep resistance. Furthermore, it would be advantageous to have available components made of the corresponding alloy, in particular for flow machines, particularly aircraft engines.

SUMMARY OF THE INVENTION

The present invention provides a TiAl alloy for high-temperature applications. The alloy comprises not more than 43 at. % of Al, from 3 at. % to 8 at. % of Nb, from 0.2 at. % to 3 at. % of Mo and/or Mn, from 0.05 at. % to 0.5 at. % of B, from 0.1 at. % to 0.5 at. % of C, from 0.1 at. % to 0.5 at. % of Si, and Ti as balance.

In one aspect, the alloy of the present invention may comprise not more than 43 at. % of Al, from 3.5 at. % to 4.5 at. % of Nb, from 0.8 at. % to 1.2 at. % of Mo and/or Mn, from 0.05 at. % to 0.15 at. % of B, from 0.2 at. % to 0.4 at. % of C, from 0.2 at. % to 0.4 at. % of Si, and Ti as balance. For example, the alloy may comprise 43 at. % of Al, 4 at. % of Nb, 1 at. % of Mo, 0.1 at. % of B, 0.3 at. % of C, 0.3 at. % of Si, and Ti as balance.

In another aspect, the alloy of the present invention may comprise γ-TiAl, $\alpha_2$-$Ti_3Al$ and $\beta_o$/B2-Ti at room temperature.

The present invention also provides a process for producing a component made of the TiAl alloy of the present invention as set forth (including the various aspects thereof). The process comprises subjecting a cast and/or cold- and/or hot-formed intermediate product to a heat treatment. The heat treatment comprises annealing at a temperature of from about 800° C. to about 900° C. for from about 4 to about 8 hours.

In one aspect of the process, the annealing may take place at a temperature of or about 850° C. for about 6 hours.

In another aspect, the annealing may be ended by rapid cooling.

In yet another aspect of the process, the heat treatment may be carried out in two stages, where annealing represents the second stage of the heat treatment. In a still further aspect, the annealing may be preceded by aging as first stage of the heat treatment. For example, the aging may take place at a temperature of from about 950° C. to about 1300° C. for from about 0.1 hour to about 2 hours, e.g., at a temperature of from about 950° C. to about 1050° C. or at a temperature from about 1200° C. to about 1300° C., each for from about 0.25 hour to about 1 hour.

The present invention also provides a component of a flow machine, which component is made of or comprises the TiAl alloy of the present invention as set forth above (including the various aspects thereof). For example, the component may be suitable for use at temperatures of up to about 850° C. and/or may be intended for use at operating temperatures of from about 800° C. to about 830° C.

The present invention makes it possible to improve the creep resistance of the known TNM alloys and thus increase the possible use temperatures. For this purpose, it is proposed, starting out from the known composition of the TNM alloys, to limit the aluminum content to a maximum of 43 at. %. In addition, it is proposed that not only boron but also carbon and silicon be necessarily provided in the alloy, with the constituents each being in the range from 0.1 at. % to 0.5 at. %. The combined and targeted measure of reducing the aluminum content and at the same time providing particular proportions of carbon and silicon enables the creep resistance of a TiAl alloy of this type to be significantly improved and the use temperature thus to be increased to the range from 800 to 850° C.

Thus, the chemical composition of such an alloy may comprise not more than 43 at. % of aluminum, from 3 to 8 at. % of niobium, from 0.2 at. % to 3 at. % of molybdenum and/or manganese, from 0.05 at. % to 0.5 at. % of boron, from 0.1 at. % to 0.5 at. % of carbon, from 0.1 at. % to 0.5 at. % of silicon, and titanium and unavoidable impurities as balance.

The TiAl alloy may, for example, comprise not more than 43 at. % of aluminum, from 3.5 at. % to 4.5 at. % of niobium, from 0.8 at. % to 1.2 at. % of molybdenum and/or manganese, from 0.05 at. % to 0.15 at. % of boron, from 0.2 at. % to 0.4 at. % of carbon, from 0.2 at. % to 0.4 at. % of silicon, and titanium and unavoidable impurities as balance.

A TiAl alloy comprising 43 at. % of aluminum, 4 at. % of niobium, 1 at. % of molybdenum, 0.1 at. % of boron, 0.3 at. % of carbon, 0.3 at. % of silicon, and titanium and unavoidable impurities as balance has been found to be advantageous. The values indicated are not absolute values but instead represent target values from which it is possible to deviate within the limits of technical achievability, and can thus be adjusted within a particular accuracy range according to the recognized rules of technology.

Such an alloy has, at room temperature and use temperatures, a microstructure which comprises the phases γ-TiAl, $\alpha_2$-$Ti_3Al$ and $\beta_o$/B2-titanium, where the B2- or $\beta_o$-phase represents an ordered variant of β-titanium.

A corresponding component comprising a TiAl alloy according to the invention can be produced by casting, with or without subsequent cold and/or hot forming. A conventional process for producing corresponding components of flow machines, for example turbine blades, comprises casting a blank and subsequently hot forming this by forging. An intermediate produced correspondingly can, according to the present invention, be subjected to a heat treatment which comprises heating at a temperature in the range from 800° C. to 900° C. for from 4 to 8 hours. Such a stabilization heat treatment enables the desired microstructure of a TNM alloy to be optimized for improved creep resistance.

The heat treatment can advantageously take place at a temperature of or about 850° C. for about 6 hours.

After the heat treatment, the corresponding component can be cooled quickly, for example in the ambient atmosphere or by blowing a cooling gas onto it.

The heat treatment can comprise additional heat treatment steps in addition to the heating described above, and these take place before the heating. In particular, the heat treatment can have two stages with an aging step preceding the annealing step. The use of the terms aging and annealing does not refer, for the present purposes, to fundamentally different process mechanisms, but is merely intended to distinguish the heat treatment steps.

In addition, it is possible to carry out further thermal and/or thermomechanical treatments before or after the heat treatment described here. However, the heat treatment described here should preferably represent the final heat treatment.

The aging as first step of a two-stage heat treatment can take place at a temperature of from about 950° C. to about 1300° C. for from about 0.1 hour to about 2 hours. In particular, the aging can take place at a temperature of from about 950° C. to about 1050° C. or from about 1200° C. to about 1300° C. for a time of from about 0.25 hour to about 1 hour.

A TiAl alloy having the above composition and a component made of a corresponding TiAl alloy which has, in particular, been subjected to the above production process with the heat treatment according to the invention can advantageously be used for components of flow machines, for example blades of a flow machine.

In particular, the components can be used at temperatures up to about 850° C., in particular in the operating temperature range from about 800° C. to about 830° C.; here, operating temperature means that the temperature indicated occurs all the time during operation or the temperature can briefly arise as peak temperature during operation.

BRIEF DESCRIPTION OF THE DRAWING

The accompanying FIGURE shows, in a polished section, a typical microstructure of a material according to the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawing making apparent to those of skill in the art how the several forms of the present invention may be embodied in practice.

EXAMPLE

A blade of an aircraft engine can be produced from a TiAl alloy comprising 43 at. % of aluminum, 4 at. % of niobium, 1 at. % of molybdenum, 0.1 at. % of boron, 0.3 at. % of carbon, 0.3 at. % of silicon, and titanium as balance by firstly casting the abovementioned TNM alloy and hot-isostatically pressing the casting. It is then subjected to fine-grain forging by means of the hot die forging process above the dissolution temperature of the γ-TiAl phase ($T_{\gamma solv}$~1260° C.), as a result of which a virtually texture-free and fine-grain microstructure having an average grain size of the α-phase of ~10 μm can be obtained by dynamic recrystallization of the unordered α-titanium phase. Proportions of 10-30% by volume of β-phase and also small proportions of silicides (ζ-$Ti_5Si_3$) and carbides (H—$Ti_2AlC$) lead to increased nucleation during the forming process and thus to an improved recrystallization tendency of the α-phase (particle stimulated recrystallization). During subsequent cooling, the dissolved proportion of carbon in the α-phase retards the precipitation kinetics of the γ-TiAl phase, as a result of which the α/$\alpha_2$-phase remains supersaturated during suitable cooling.

In the next step, the fine-grained forged and supersaturated TNM alloy is subjected to a 2-stage heat treatment. In this, a targeted γ-lamellae width is set in a first aging step in order to optimize the creep properties ("short-term annealing"). In the second, subsequent annealing step just above the maximum use temperature, phase proportions close to the thermodynamic equilibrium are set ("long-term annealing"). The heat treatment process for the microstructure having a particularly good creep strength is carried out, for example, with aging at about 1000° C. for about 15 minutes with subsequent rapid cooling and heating at about 850° C. for about 6 hours and likewise rapid cooling. Here, the first aging additionally leads to the formation of a cellular reaction phase (CR) spreading out from the boundaries of the $\alpha_2$-$Ti_3Al$/γ-TiAl colonies, which, depending on the aging temperature and time, occurs in a differing amount and represents a transformation microstructure. During the second annealing at about 850° C., the driving force for the cellular reaction and the corresponding formation of the cellular reaction phase then virtually ceases because of the larger spacing of the lamellae.

The process described leads, in combination with the selected material, to significantly improved mechanical properties with a lower outlay compared to the previous processes. The avoidance of a high-temperature annealing eliminates the risk of grain growth.

A component produced in this way, for example a blade of an aircraft engine, has improved creep resistance compared to previously known TiAl alloys and in particular TNM alloys.

A characteristic microstructure of a component produced according to the invention from a TiAl alloy according to the invention is shown in the accompanying FIGURE. This microstructure is a virtually lamellar microstructure having small proportions of $\beta_o$-phase in the order of <5% by volume (NLβ).

The $\beta_o$-titanium phase can be in the form of bands or globular depending on the forming speed during forging. Lenticular γ-TiAl precipitates are present within the $\beta_o$-phase.

The microstructure consists mainly, viz. up to 98% by volume, of globular $\alpha_2$-$Ti_3Al$/γ-TiAl colonies having a maximum size of ~10-20 μm and an average width of the γ-TiAl lamellae in the order of 50-150 nm. In general, there are no globular γ-grains which can, above a proportion by volume of about >5%, lead to a reduction in the creep resistance.

The proportion by volume of cellular reaction phase (CR) is less than 10% by volume.

Before the first use, the microstructure of a corresponding component can comprise from about 70% to 80% by volume, in particular about 75% by volume, of γ-TiAl, from about 20% to 25% by volume, in particular about 23% by volume, of $\alpha_2$-$Ti_3Al$ and from about 1% to 3% by volume, in particular about 2% by volume, of $\beta_o$-Ti. The carbon is mainly present in solution. Small proportions of H carbides and silicides, in particular a total amount of less than about 3% by volume, preferably less than about 1% by volume, and cellular reaction phase (CR) can additionally be present in the microstructure, where the constituents of the microstructure naturally add up to 100% by volume and the cellular reaction phase is included in the proportions of γ-TiAl and $\alpha_2$-$Ti_3Al$.

During use of the component at the appropriate use temperatures, the proportions of γ-TiAl, $\alpha_2$-$Ti_3Al$ and $\beta_o$-Ti barely change, i.e. the microstructure remains stable, but the creep stress under use conditions leads to precipitation of very fine carbides within the γ-TiAl phase, e.g. in the form of P—$Ti_3AlC$, which contribute to hindering of the decomposition creep and thus to an increase in the creep resistance.

In addition, very fine silicide precipitates (ζ-$Ti_5Si_3$) at the $\alpha_2$-$Ti_3Al$/γ-TiAl interfaces improve the stability of the microstructure. Residues of coarser silicides can, depending on the choice of forming and heat treatment parameters, be present in the microstructure.

The fine-grained NLβ microstructure is characterized by a high high-temperature stability, creep resistance and stability of the microstructure combined with significantly improved damage tolerance below the brittle-ductile transition temperature because of the small size and globular configuration of the $\alpha_2$-$Ti_3Al$/γ-TiAl colonies.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A component made from a TiAl alloy, wherein the alloy comprises not more than 43 at. % of Al,
from 3 at. % to 8 at. % of Nb,
from 0.2 at. % to 3 at. % of Mo and/or Mn,
from 0.05 at. % to 0.5 at. % of B,
from 0.1 at. % to 0.5 at. % of C,
from 0.1 at. % to 0.5 at. % of Si and
Ti as balance;

and wherein the component has a microstructure comprising from about 70% to 80% by volume of γ-TiAl, from about 20% to 25% by volume of $\alpha_2$-$Ti_3Al$, and from about 1% to 3% by volume of $\beta_o$-Ti.

2. The component of claim 1, wherein the alloy comprises not more than 43 at. % of Al,
from 3.5 at. % to 4.5 at. % of Nb,
from 0.8 at. % to 1.2 at. % of Mo and/or Mn,
from 0.05 at. % to 0.15 at. % of B,
from 0.2 at. % to 0.4 at. % of C,
from 0.2 at. % to 0.4 at. % of Si and
Ti as balance.

3. The component of claim 1, wherein the alloy comprises 43 at. % of Al,
4 at. % of Nb,
1 at. % of Mo,
0.1 at. % of B,
0.3 at. % of C,
0.3 at. % of Si and
Ti as balance.

4. The component of claim 1, wherein the microstructure of the component comprises at least one of about 75% by volume of γ-TiAl, about 23% by volume of $\alpha_2$-$Ti_3Al$, and about 2% by volume of $\beta_o$-Ti.

5. The component of claim 1, wherein the microstructure of the component comprises about 75% by volume of γ-TiAl, about 23% by volume of $\alpha_2$-$Ti_3Al$, and about 2% by volume of $\beta_o$-Ti.

6. The component of claim 1, wherein the microstructure of the component further comprises silicide precipitates ζ-$Ti_5Si_3$) at $\alpha_2$-$Ti_3Al$/γ-TiAl interfaces.

7. The component of claim 2, wherein the microstructure of the component comprises at least one of about 75% by volume of γ-TiAl, about 23% by volume of $\alpha_2$-$Ti_3Al$, and about 2% by volume of $\beta_o$-Ti.

8. The component of claim 2, wherein the microstructure of the component further comprises silicide precipitates (ζ-$Ti_5Si_3$) at $\alpha_2$-$Ti_3Al$/γ-TiAl interfaces.

9. A flow machine, wherein the flow machine comprises the component of claim 1.

10. A process for producing the component of claim 1, wherein the process comprises subjecting a cast and/or cold- and/or hot-formed intermediate product to a heat treatment which comprises annealing at a temperature of from about 800° C. to about 900° C. for from about 4 to about 8 hours.

11. The process of claim 10, wherein annealing is carried out at a temperature of or about 850° C. for about 6 hours.

12. The process of claim 10, wherein annealing is followed by rapid cooling.

13. The process of claim 10, wherein the heat treatment is carried out in two stages, annealing representing a second stage of the heat treatment.

14. The process of claim 13, wherein annealing is preceded by aging at a temperature of from about 950° C. to about 1300° C. for from about 0.1 to about 2 hours.

15. The process of claim 13, wherein annealing is preceded by aging at a temperature of from about 950° C. to about 1050° C. or at a temperature from about 1200° C. to about 1300° C. for from about 0.25 to about 1 hour.

* * * * *